US005182412A

United States Patent [19]

Mazza

[11] Patent Number: 5,182,412

[45] Date of Patent: Jan. 26, 1993

[54] SPEED LOADER FOR MUZZLE-LOADING FIREARMS

[76] Inventor: Dominick J. Mazza, 20 Hospital St., Carbondale, Pa. 18407

[21] Appl. No.: 830,818

[22] Filed: Feb. 4, 1992

[51] Int. Cl.[5] ..... F41C 27/00

[52] U.S. Cl. ..... 42/90

[58] Field of Search ..... 42/87, 88, 90

[56] References Cited

U.S. PATENT DOCUMENTS

| | | | |
|---|---|---|---|
| 2,573,003 | 10/1951 | Fraley | 42/87 |
| 4,536,983 | 8/1985 | Fry | 42/90 |
| 4,571,873 | 2/1986 | Houk | 42/90 |
| 4,601,125 | 7/1986 | Curtis | 42/90 |
| 5,081,781 | 1/1992 | Kanyuck et al. | 42/90 |

*Primary Examiner*—Charles T. Jordan
*Attorney, Agent, or Firm*—Martin Farrell

[57] ABSTRACT

A device for the accelerated loading of muzzle-loading firearms is disclosed. The device comprises a cylinder, having a plurality of vertically located bores, rotatably mounted to a base having a single through hole. The device is positioned over the muzzle of the firearm, facilitated by a countersunk hole in the base; the cylinder is rotated until a bore containing a prepared load is in position over the through hole. When this is done, gunpowder falls into the barrel of the firearm and the patch and ball are then pushed through and into position with a priming rod. The vertical surface of the cylinder has a plurality of transparent windows which allow the viewing of the interior of each of the cylindrical bores. Each of the windows is marked with graduations to indicate the volume of the corresponding bore which allows the accelerated loading of powder into the device and allows the user, when in the field, to visually verify the amount and condition of the powder residing in the device.

3 Claims, 3 Drawing Sheets

SPEED LOADER FOR MUZZLE-LOADING FIREARMS

BACKGROUND OF THE INVENTION

The present invention pertains to the loading of muzzle-loading firearms. More particularly, the invention relates to a multiple chambered device for quickly and easily reloading a muzzle-loaded firearm.

There are various implements known in the prior art which facilitate the loading of muzzle-loading firearms. These generally fall into two categories: carriers, that is, devices which simply carry all of the necessary elements for loading in a convenient container, and loaders, devices which carry the elements as a prepared load or loads which may be directly transferred to the firearm. Some of the loaders are designed to carry multiple prepared shots; these multiple loaders offer the advantage of rapid reloading a number of times in succession. Of the carriers, some include a means of measuring the powder as it is preloaded into the device, which allows for increased accuracy in loading the powder. One loader offers a means of visually verifying the amount of powder held in the loading device. None of the known devices, excepting the present invention, provides multiple shot loading capability with a means of directly measuring powder as it is put in the device and a means of visually verifying the prepared load contained in the device.

Devices such as U.S. Pat. No. 4,550,517, to Mansfield, and U.S. Pat. No. 4,442,620 to Drake, et al., are typical examples of the cylindrical and linear formats devised for multitude loaders. In order to load these devices, one must weigh or premeasure the desired amount of powder prior to putting the powder in the loading device because no measuring means is included to assist the loading procedure. In addition, neither Mansfield nor Drake provides a means for the visual inspection of the preloaded powder, patch and ball in the device. Another device, U.S. Pat. No. 4,875,303 to DeWeert et al., a single shot loader, provides a graduated shaft to indicate the amount of powder charge in the loading device, which also functions as a priming rod to push the load into the muzzle of the firearm. DeWeert, however, has a significant limitation in that it is designed for a single shot use. Finally of interest is a carrier, U.S. Pat. No. 4,112,606 to Griffin, which discloses an elongated graduated container for carrying the powder, which must be poured from the container into the muzzle of the gun. Griffin is similarly limited for one shot use only. While the above referenced single shot devices may offer increased accuracy in the preparation of the powder charge, the single shot limitation, of course offering no means to reload more than once in succession, renders these devices slower than the multiple shot devices if more than one reload is desired.

Other loaders such as U.S. Pat. No. 4,094,098 to Gourley, U.S. Pat. No. 163,404, to Phillips, and U.S. Pat. No. 11,174 to Peavey, are all multiple shot devices. While these multiple shot devices offer the advantage of speed in reloading the firearm, all lack a means to facilitate the rapid, accurate reloading of the device itself, and a means of visually inspecting the various loads contained within the device. The lack of a measuring means in these devices creates an inherent lack of accuracy in preparing the preloads in the devices. The present invention overcomes the limitations known to the art by providing a single device having multiple load carrying capability, rapid multiple reloading capability, and rapid and accurate loading of the speed-loading device.

SUMMARY OF THE INVENTION

The ingredients and implements which are necessary to load a muzzle-loading firearm, typically referred to as the "load" or the "shot," include the powder, the ball, and the patch. The loading of a muzzle-loading firearm includes the steps of measuring a preselected amount of powder charge; pouring the premeasured powder into the muzzle; placing a patch and projectile in the muzzle; and priming the firearm by pushing and compressing the load into the breach end of the firearm with a priming rod. With the insertion of these elements into the barrel of the firearm, the firearm is considered to be loaded. A speed loading device which carries these ingredients in preloaded form for quick loading into the firearm must also, generally, be loaded by this method without, of course, the final step of priming the load in the barrel.

When preloading a multiple shot loading device, the measurement of several loads of powder, which must be repeated for each shot, becomes cumbersome and subject to error. The accurate preparation of the powder charge is critical to the success of the shooter as the accuracy of the firearm itself depends on having a properly prepared charge. In general, the amount of powder will affect the range at which the firearm is effective; too little powder may result in the shot not reaching the target, while too much powder may, in the extreme, cause the firearm to explode, presenting a serious danger to the shooter. Within these extremes, each shooter will, with practice and experience, determine what specific powder charge is best adapted to his ability, shooting habits and the particular firearm and projectile being used. In addition, other factors, such as wind or precipitation, may also affect the size of the powder charge the shooter desires to use.

The prepared loading device is carried by the shooter to the hunting or shooting locale. After the shooter takes his first shot, it is convenient, in the case of a target shooter, and often critical, in the case of a hunter, to reload as quickly as possible. Moreover, adverse weather conditions, such as rain or snow, may affect the condition of the powder. In addition, as mentioned above, the shooter may wish to have ready loads of different powder volume to accommodate the various conditions which may be encountered in the field. It is therefore also desirable, for both the target shooter and the hunter, to visually verify the size and condition of the load before loading it into the firearm. One object of the present invention is to allow the shooter to completely reload a muzzle-loaded firearm quickly and accurately a plurality of times. Another object of the present invention is to provide a speed loading device that has a means for visually verifying the prepared loads as they are contained in the device.

Yet another object of the invention is to provide a self contained tool having a measuring capability so that the desired amount of powder can be placed directly into the speed loader without premeasurement, thus facilitating the accelerated reloading of the speed loader itself and providing an economy of motion not known in loading devices.

An additional object of the present invention is to provide a tool which functions as a complete unit and which does not require additional tools and measuring devices in its operation.

Other objects and advantages of the present invention will become apparent from the following description of the preferred embodiments and drawings.

DESCRIPTION OF THE PREFERRED EMBODIMENT

Figure 1:
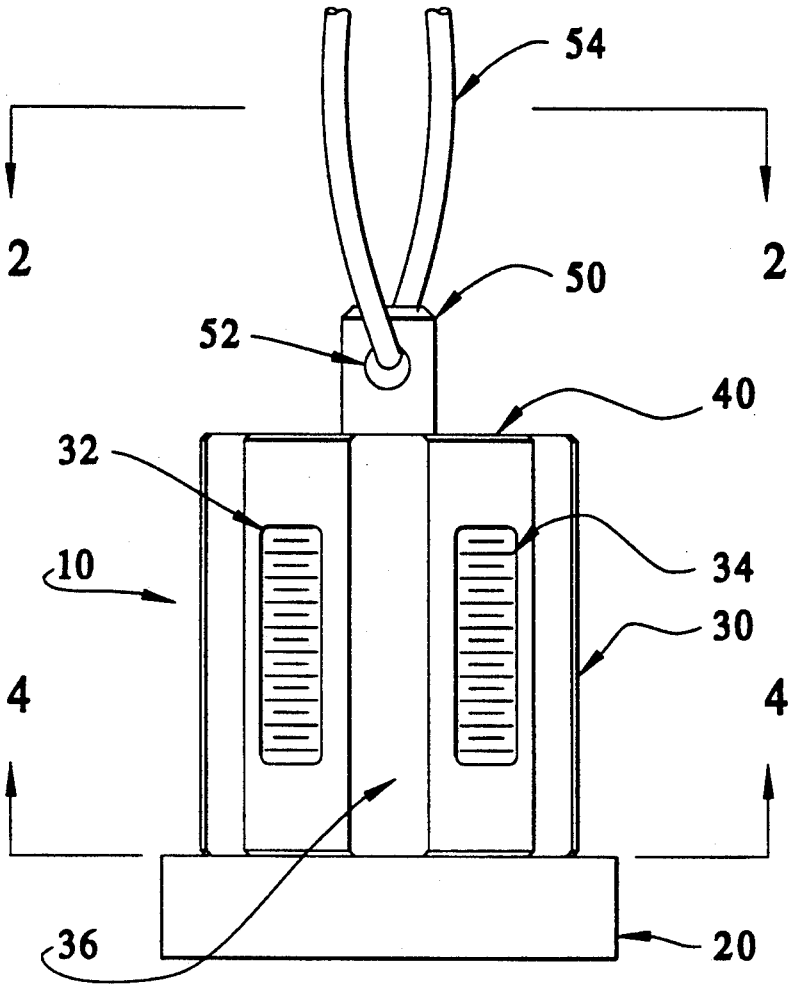
FIG. 1 is a front elevation view of the speed loader.

Referring more specifically to the drawings, FIG. 1 shows the speed loader 10 comprising base 20 having rotatably mounted thereon cylinder 30. The cylinder and base may be formed of any suitable rigid material, such as metal, plastic, or composites, and in the preferred embodiment are made of aluminum. Located generally centrally at the upper portion of cylinder 30 is lug 50 having strap-hole 52. Disposed through strap-hole 52 is carrying strap 54. Cylinder 30 is provided with a plurality of vertical cylinder bores 40, which are also shown in more detail in FIG. 2. A means of providing visual access to cylindrical bores 40 is provided. In the embodiment shown, viewing window 32 are located on the vertical face of cylinder 30 to correspond with, and provide visual access to cylindrical bores 40. In this regard, each viewing window will correspond to a specific cylindrical bore of cylinder 30. Preferably, viewing windows are made of hard, durable transparent material such as glass or plastics. Viewing windows 32 have a series of graduations 34 which correspond to volume or mass calibrations of the corresponding cylindrical bore. Graduations may be etched on the surface of the viewing windows, or applied with paint, ink or by any other suitable material. In other embodiments, cylinder 30 may be formed of clear, durable material such as poly-acrylate, thus providing visual access to the interior of cylindrical bores 32. In such embodiments, graduations 34 would be similarly provided on the vertical face of cylinder 30 at locations corresponding to cylindrical bores. Situated between viewing windows 32 are knurls 36.

Figure 2:
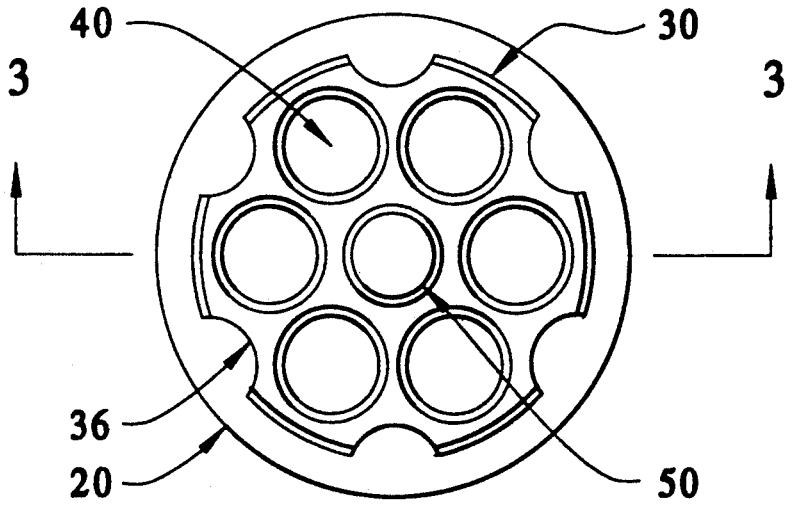
FIG. 2 is a top plan view of the speed loader.

As shown in FIG. 2, cylinder 30 has a plurality, preferably six, of cylindrical bores 40 passing vertically through cylinder 30. Cylindrical bores 40 are located on a circle concentric with the axis of rotation of cylinder 30. The axis of rotation generally coincides with the location of lug 50 as shown in FIG. 2. Preferably, cylindrical bores 40 are sized to a diameter consistent with the caliber of the firearm for which the speed loader may be used. Cylinder 30 is formed with a plurality of knurls 36 to facilitate gripping and rotating the cylinder by the user, and which generally correspond to separations between cylinder bores. Shown below cylinder 30 is base 20.

Figure 3:
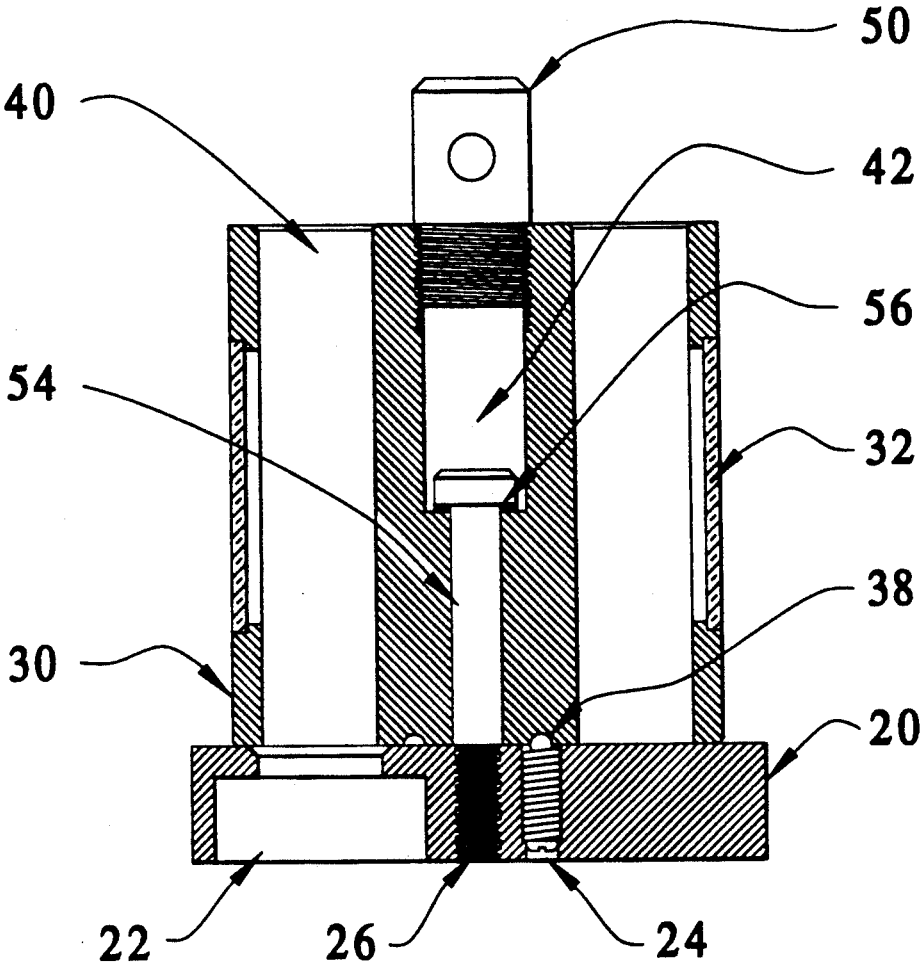
FIG. 3 is a side cross-sectional view taken along the line 3—3 of FIG. 2.

FIG. 3, which is a side cross-sectional view of the present invention, shows base 20 having through-hole 22, which is located to permit alignment with cylindrical bores 40. In the preferred embodiment, through-hole 22 is counter-bored on the bottom face of base 20 to provide a means of positively aligning the muzzle of the firearm in its intended place, as more fully shown in FIG. 5. The counter-bored end of through hole 22 is sized to mateably fit the outside diameter of the firearm muzzle which seats within the counter-bore. The opposite, or through, end of through-hole 22 is sized consistent with the diameter of cylindrical bores 40. In alternative embodiments the alignment of through hole 22 with the muzzle of the firearm may be accomplished by providing through hole 22 with an O-ring or washer, or by providing base 20 with a collar. As shown in FIG. 3, spring ball 24 mounted in base 20 engages detent 38 located on the bottom face of cylinder 30. The spring ball/detent system provides a means of indexing cylinder 30 to insure alignment of selected cylindrical bores 40 with through hole 22. Cylinder 30 has centrally located, counter sunk hole 42. Bolt 54 is set in hole 42 and mates with threaded hole 26 in base 20 to fasten cylinder 30 to base 20 and to form the axis of rotation of the system. Coil spring 56 is placed under the head of bolt 54 to provide tension to prevent loosening. Coil spring 56 is sized to have an outside diameter generally consistent with the inside diameter of hole 42. Rotation of cylinder 30 in the direction opposite the winding of the coil spring is resisted by friction of the spring body, assisted by spring tension, against the inside surface of hole 42. In the preferred embodiment, this feature helps insure that cylinder 30 will be rotated in one direction only, so that the user may be assured of his progression through the prepared loads in the desired order. In alternative embodiments, detents 38 may be formed or shaped with a taper on one edge so that directional rotational resistance is provided by means of the spring ball-detent system.

As shown and described by the figures thus far, cylindrical bores 40 are equipped with viewing windows 32. The windows are marked with graduations 34 which indicate the volume of the corresponding cylindrical bore. When preparing preloads in the speed loader, the user may thus pour powder directly into the cylindrical bore until the desired level is reached as indicated by graduations 34. This relieves the user of the additional prior step of premeasuring the powder and facilitates the accelerated and accurate loading of the speed loader. In addition, when in the field, viewing windows enable the user to directly view the powder contained in the speed loader to verify the amount and condition of the powder.

Figure 4:
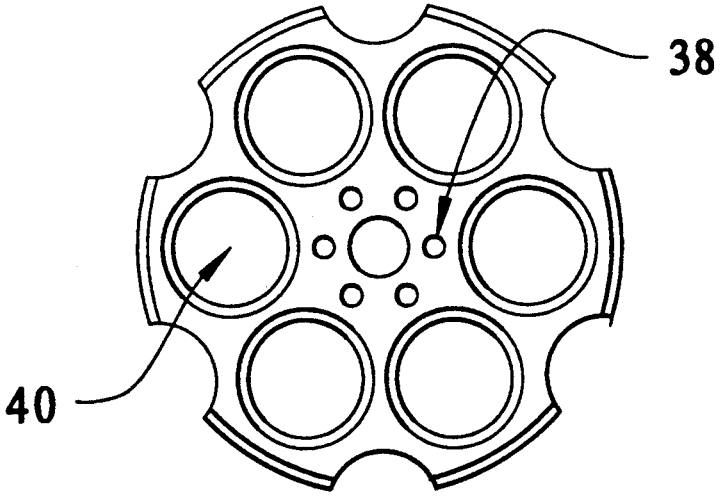
FIG. 4 is a bottom plan view taken along the line 4—4 of FIG. 1 which discloses the bottom of the rotating cylinder as removed from the base.

FIG. 4 shows a bottom plan view of cylinder 30 showing the arrangement of detents 38 on the bottom face of the cylinder to provide positive alignment of the cylindrical bores 40 with the through-hole 22 of base 20.

Figure 5:
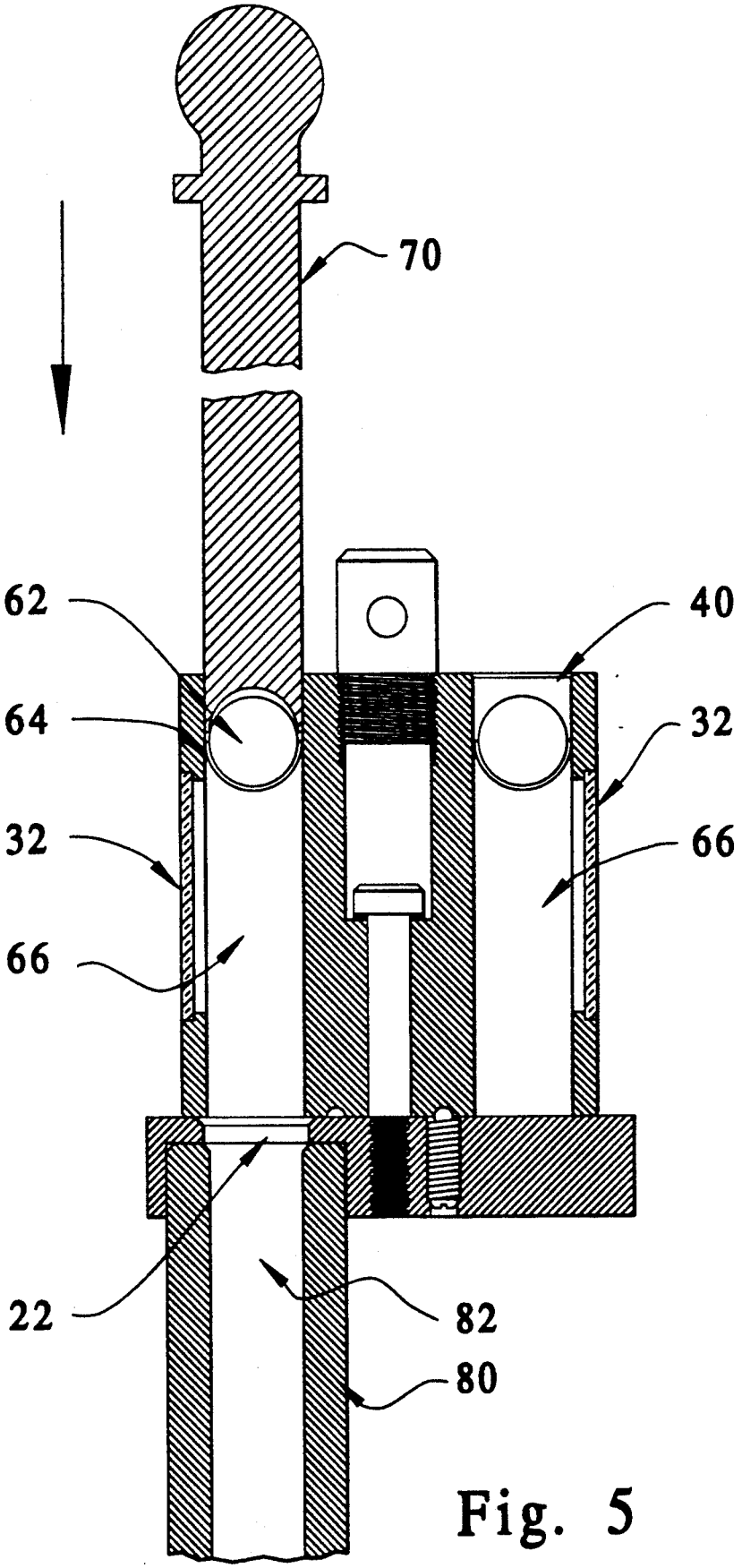
FIG. 5 is the sectional view taken along line 3—3 of FIG. 2 showing the speed loader as may be used during the loading procedure in relation to the muzzle of a firearm.

FIG. 5 shows a side cross-sectional view of the speed loader in relation to the muzzle of the firearm. When loaded, cylindrical bores 40 contain ball 62, patch 64, and powder 66 in the same configuration as they are to be placed in the firearm. As shown, viewing window 32 provides visual access to the load as contained in cylindrical bore 40. As will be appreciated by the embodiment in the drawings, the fully loaded speed loader of the present invention will hold five prepared loads. Since one cylindrical bore (designated a "dummy" bore) will always be aligned with through-hole 22, it is incapable of containing a prepared load. The dummy bore may be used to store priming rod 70 until the speed loader is first used. When the present invention is used to load a firearm thus described, the speed loader is placed over the muzzle of the firearm as shown in FIG. 5, with firearm 80 inserted into the countersunk end of through-hole 22. Cylinder 30 is rotated until a cylindrical bore 40 containing ball 62, patch 64 and powder 66 is aligned over through hole 22, and thus, with muzzle 82. Priming rod 70 (shown in breakaway) is used to push the prepared load from the loading device into the muzzle 82 of the firearm 80 (also shown in breakaway). A standard ramrod (not shown) is used to push and compress the load fully into the breech of the firearm. After use, priming rod 70 may be placed in the empty cylindrical bore for storage.

The foregoing description is illustrative of the the preferred embodiment as shown. It is not intended to limit the present invention to the specific construction shown and described.

What is claimed is:

1. An apparatus for loading muzzle-loading firearms, comprising:

(a) a base having upper and bottom surfaces;

(b) a cylinder having a top face, a bottom face, and a vertical face, said bottom face being rotatably mounted to the upper surface of the base and said vertical face being formed with knurls;

(c) said cylinder having a plurality of concentrically located, cylindrical bores extending from the top face to the bottom face of said cylinder, each of said bores having a diameter generally consistent with that of the caliber of the firearm to be loaded;

(d) said cylinder having a plurality of viewing windows located on the vertical face and aligned with each of said cylindrical bores, said viewing windows having painted graduations to indicate the volume of a cylindrical bore as seen through said viewing window;

(e) said base having a through hole generally consistent in diameter with that of said cylindrical bores, said through hole being located to permit alignment with said cylindrical bores, and said through hole being countersunk from the bottom surface with a countersunk hole of diameter generally consistent with that of the outside diameter of the firearm to be loaded;

(f) a coil spring located at the base cylinder mounting to provide rotational resistance in one direction only; and (g) said bottom face having a plurality of concentrically located detents to releasably engage a spring ball located in said upper surface of said base to provide positive alignment of said cylindrical bores with said through hole.

2. An apparatus for loading muzzle-loading firearms, comprising:

(a) a base having upper and bottom surfaces;

(b) a cylinder having a top face, a bottom face, and a vertical face, said bottom face being rotatably mounted to the upper surface of the base and said vertical face being formed with knurls;

(c) said cylinder being made of a transparent tough material;

(d) said cylinder further having a plurality of concentrically located, cylindrical bores extending from the top face to the bottom face of said cylinder, each of said bores having a diameter generally consistent with that of the caliber of the firearm to be loaded;

(d) said cylinder having on the vertical face a plurality of graduations to indicate the volume of said cylindrical bores;

(e) said base having a through hole generally consistent in diameter with that of said cylindrical bores, said through hole being located to permit alignment with said cylindrical bores, and said through hole being countersunk from the bottom surface with a countersunk hole of diameter generally consistent with that of the outside diameter of the firearm to be loaded;

(f) a coil spring located at the base cylinder mounting to provide rotational resistance in one direction only; and (g) said bottom face having a plurality of concentrically located detents to releasably engage a spring ball located in said upper surface of said base to provide positive alignment of said cylindrical bores with said through hole.

3. An apparatus for loading muzzle-loading firearms, comprising:

(a) a base having upper and bottom surfaces;

(b) a cylinder having a top face, a bottom face, and a vertical face, said bottom face being rotatably mounted to the upper surface of the base;

(c) said cylinder having a plurality of concentrically located, cylindrical bores extending from the top face to the bottom face of said cylinder;

(d) said cylinder further including a plurality of transparent viewing windows, said viewing windows being made of a material selected from the group consisting of glass and plastic, and located on the vertical face and aligned with said cylindrical bores to permit viewing of said cylindrical bores;

(e) said viewing windows further being provided with graduations which indicate the volume of said cylindrical bores, said graduations being applied by a method chosen from the group consisting of painting, inking and etching;

(f) said base having a through hole located to permit alignment with said cylindrical bores, said through hole being countersunk from the bottom surface with a countersunk hole of diameter generally consistent with that of the outside diameter of the firearm muzzle to be loaded;

(g) a coil spring located at the cylinder base mounting to provide rotational resistance; and (h) a plurality of detents located on said bottom surface of said cylinder and a spring ball located in said upper face of said base to releasably engage said detents when the cylinder is rotated to provide positive alignment of said cylindrical bores with said through hole.

* * * * *